US005207454A

United States Patent [19]

Blankenburg et al.

[11] Patent Number: 5,207,454

[45] Date of Patent: May 4, 1993

[54] IN-LINE ROLLER SKATE WITH BALL ROLLERS

[76] Inventors: Karl Blankenburg, 32131 Claeys Dr., Warren, Mich. 48093; Karl Van Blankemburg, 61830 Lantern Cover, Washington, both of Mich. 48094

[21] Appl. No.: 854,482

[22] Filed: Mar. 20, 1992

[51] Int. Cl.[5] ..... A63C 17/24

[52] U.S. Cl. ..... 280/843; 280/11.22

[58] Field of Search ..... 280/11.22, 843, 11.19, 280/842, 11.27, 11.23

[56] References Cited

U.S. PATENT DOCUMENTS

| | | | |
|---|---|---|---|
| 862,431 | 8/1907 | Armband . | |
| 904,088 | 11/1908 | Rother | 280/843 |
| 3,351,353 | 11/1967 | Weitzner | 280/7.13 |
| 3,522,951 | 8/1970 | Tyson | 280/11.1 |
| 4,076,263 | 2/1978 | Rand | 280/11.1 BR |
| 4,149,735 | 4/1979 | Blackburn et al. | 280/843 X |
| 4,572,529 | 2/1986 | Thomas | 280/11.1 BR |
| 4,909,523 | 3/1990 | Olson | 280/11.2 |
| 5,028,058 | 7/1991 | Olson | 280/11.22 |

FOREIGN PATENT DOCUMENTS

| | | | |
|---|---|---|---|
| 232065 | 8/1987 | European Pat. Off. | 280/843 |
| 494395 | 3/1930 | Fed. Rep. of Germany | 776/19 |
| 21056 | of 1899 | United Kingdom | 280/843 |
| 2378 | of 1911 | United Kingdom | 280/843 |

*Primary Examiner*—Margaret A. Focarino
*Assistant Examiner*—Michael Mar
*Attorney, Agent, or Firm*—Basile and Hanlon

[57] ABSTRACT

An in-line roller skate includes a frame having a pair of parallel, spaced side rails. At least one and, preferably, a plurality of ball rollers are mounted in the frame between the forward and rearward ends of the frame. Each ball roller is mounted to the frame for unidirectional movement by a base attached to the frame. A concave bed is formed in the base and is substantially covered by a plurality of rotatable bearings. A cap having a central aperture in an end wall is secured to the base and encloses the bearings and the ball roller, with a portion of the ball roller extending through the central aperture in the cap. In another embodiment, an axle is centrally located in the frame and extends perpendicularly through the side rails and rotatably supports a cylindrical wheel thereon. Ball rollers are mounted forward and rearward of the wheel depending on the location of the wheel in the frame. The frame is fixedly attached to a boot of a sole member with a plurality of straps with closures mounted on the sole member for releasably attaching the sole and the frame to a foot of a user.

15 Claims, 3 Drawing Sheets

IN-LINE ROLLER SKATE WITH BALL ROLLERS

BACKGROUND OF THE INVENTION

1. Field of the Invention

The present invention relates, in general, to roller skates and, specifically, to in-line roller skates.

2. Background Description

Conventional roller skates generally employ two pairs of cylindrical wheels, one pair mounted at the toe and one mounted at the heel of a boot or shoe. Each pair of wheels is rotatably mounted on axles secured to the boot or shoe. Due to this construction, the wheels exhibit only fore and aft movement.

Much interest has recently been generated in so-called "in-line" roller skates which include a plurality of wheels arranged axially in-line along the length of a boot. The wheels are attached by axles oriented perpendicular to a frame attached to the sole of the boot. While such in-line roller skates have become quite popular, the in-line arrangement of the wheels still enables only fore and aft movement of the wheels.

It has been proposed to employ balls instead of cylindrical wheels or rollers in order to provide additional degrees of movement of roller skates, particularly, sideways movement. In roller skates utilizing ball rollers, the balls are supported in sockets mounted to a skate frame. Ball bearings are disposed in the sockets for rotatably supporting the balls. However, such previously devised roller skates utilizing ball rollers incorporate only a few ball bearings arranged in one or two lines or races in the sockets. This has resulted in restricted freedom of movement of the balls and high friction levels for the balls. Further, roller skates utilizing only ball rollers provides a skater with little directional control.

Various arrangements have been proposed to increase the directional control of roller skate utilizing ball rollers while providing some degree of universal movement of the roller skate. However, such arrangements require complicated and, therefore, expensive friction enhancing mechanisms or result in a roller skate which is not particularly suited for use as an in-line roller skate.

Thus, it would be desirable to provide an in-line roller skate which provides universal movement of the roller skate with directional control. It would also be desirable to provide an in-line roller skate which is simple in construction for a low manufacturing cost.

SUMMARY OF THE INVENTION

The present invention is an in-line roller skate which incorporates an integral boot or shoe or which may be releasably attached to the foot or shoe of a user.

The in-line roller skate of the present invention includes a frame having a top, a bottom, and a pair of parallel, spaced, side rails extending between opposed front and rear ends. Means are provided for attaching the frame to a boot, or about the foot or shoe of a user.

In one embodiment an axle is mounted in and extends between the side rails of the frame. The axle is disposed between the opposed front and rear ends of the side rails and is oriented perpendicular to the longitudinal extent of the side rails. A wheel is rotatably mounted on the axle for rotation about the axis of the axle. At least one front ball roller is disposed forward of the axle and wheel. Further, at least one rear ball roller is optionally disposed rearward of the axle and wheel in the frame.

Ball mounting means are mounted in the frame for rotatably mounting the front ball roller and the rear ball roller to the frame. The ball mounting means includes a base which is attached to the frame. The base has an inverted concave bed formed therein. A plurality of ball bearings are rotatably disposed on the bed and cover substantially the entire surface of the bed. A cap is mountable over the base and has an aperture formed in an end wall thereof. The ball roller rotatably engages the bearings in the bed, with a portion of the ball roller extending through the aperture in the cap for engaging an underlying surface.

In one exemplary embodiment, at least two ball rollers are mounted axially in line with and forward of the central wheel. Further, at least two ball rollers are axially mounted in line rearward of the central wheel. Each of the front and rear ball rollers is provided with its own ball mounting means for attachment to the frame.

The frame, the central wheel, the ball mounting means and the ball rollers are preferably formed of plastic materials for a minimal weight, easy manufacturing and a low cost.

The frame can be directly attached to a boot which releasably receives a foot of a user. Alternately, the frame may be fixedly attached to a planar sole member. Connector means, such as pairs of straps with releasably engagable closure members, are attached to the frame or the sole member for releasably attaching the sole member to the foot of a user.

In another embodiment, a plurality of ball rollers are mounted co-axially in the frame. The above-described ball mounting means is provided for each ball roller.

The in-line roller skate of the present invention provides unique advantages over previously devised in-line roller skates due to the use of universally rotatable ball rollers on opposite sides of a fixed central wheel which is mounted for only fore and aft movement about an axle. Bearings covering substantially all of the surface of a bed in the ball mounting means provide greater ease of rotation of the ball rollers and more support for the ball rollers. This construction provides a greater degree of movement to the roller skate to enable the user to more easily execute spins, turns, etc. When a more directional control is desired, the wheel on a fixed axle can be mounted in the frame.

The frame, ball rollers, central wheel and ball mounting means are preferably formed of plastic materials for reliable, long term use and a low manufacturing cost. Such rollers may be used outdoors on concrete or asphalt surfaces as well as indoors on any hard surface, such as wood surfaces.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
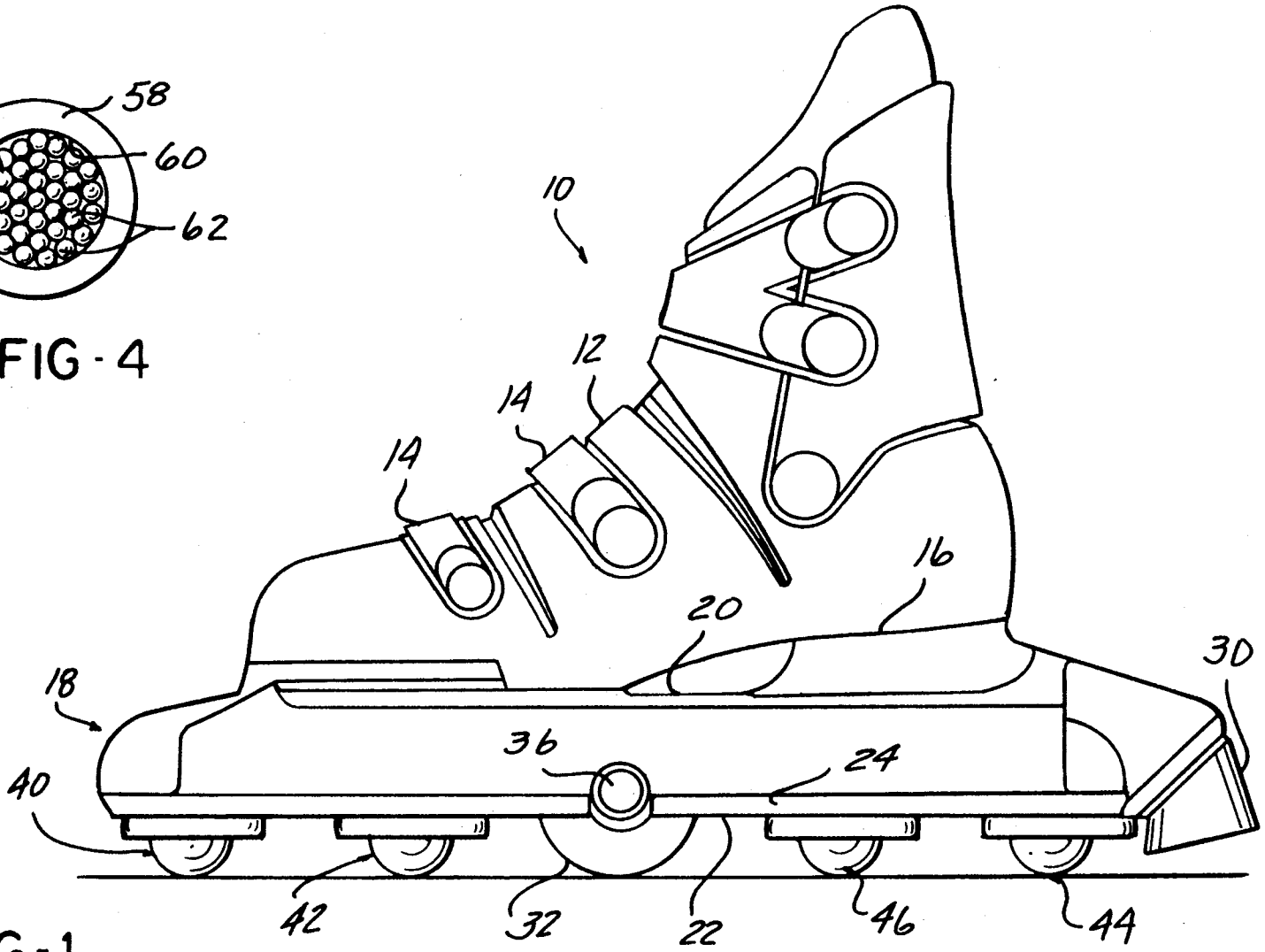
FIG. 1 is a side elevational view of an in-line roller skate constructed in accordance with one embodiment of the present invention.

Referring now to the drawing, and to FIG. 1 in particular, there is illustrated an in-line roller skate 10 having a fixedly mounted, central wheel and one or more front and rear mounted ball rollers.

Figure 5:
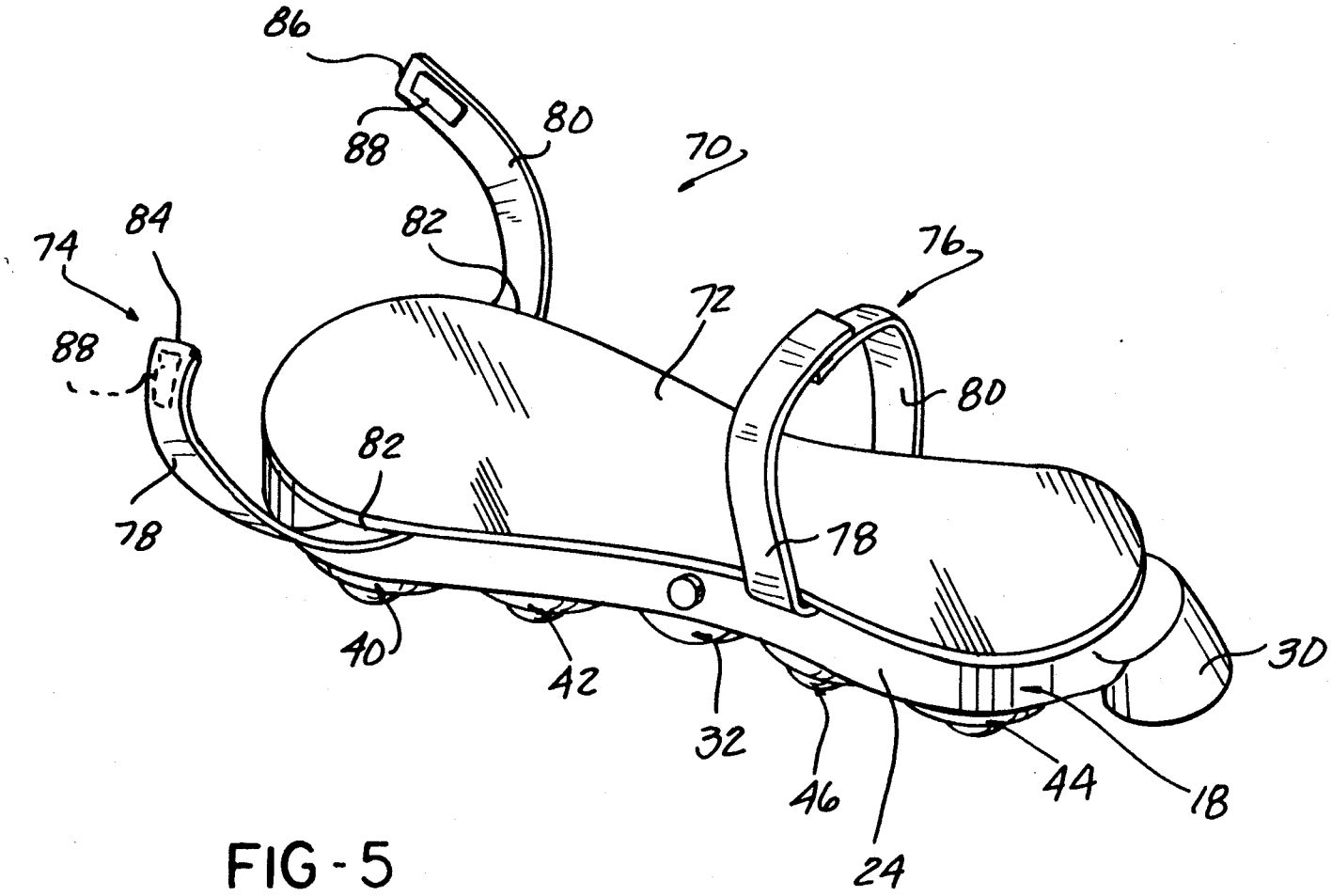
FIG. 5 is a perspective view of another embodiment of the in-line roller skate of the present invention.

The roller skate 10 of the present invention is capable of use in two separate embodiments, namely, with an integral boot as shown in FIG. 1 or as a clip-on attachment to a user's foot and/or shoe or boot as shown in FIG. 5

The boot 12 shown in FIG. 1 may be of any conventional construction. Further, the boot 12 may be releasably closed about a user's foot by means of laces, straps or other fasteners shown generally by reference number 14. The boot 12 also includes a sole 16 on a lower surface.

Figure 2:
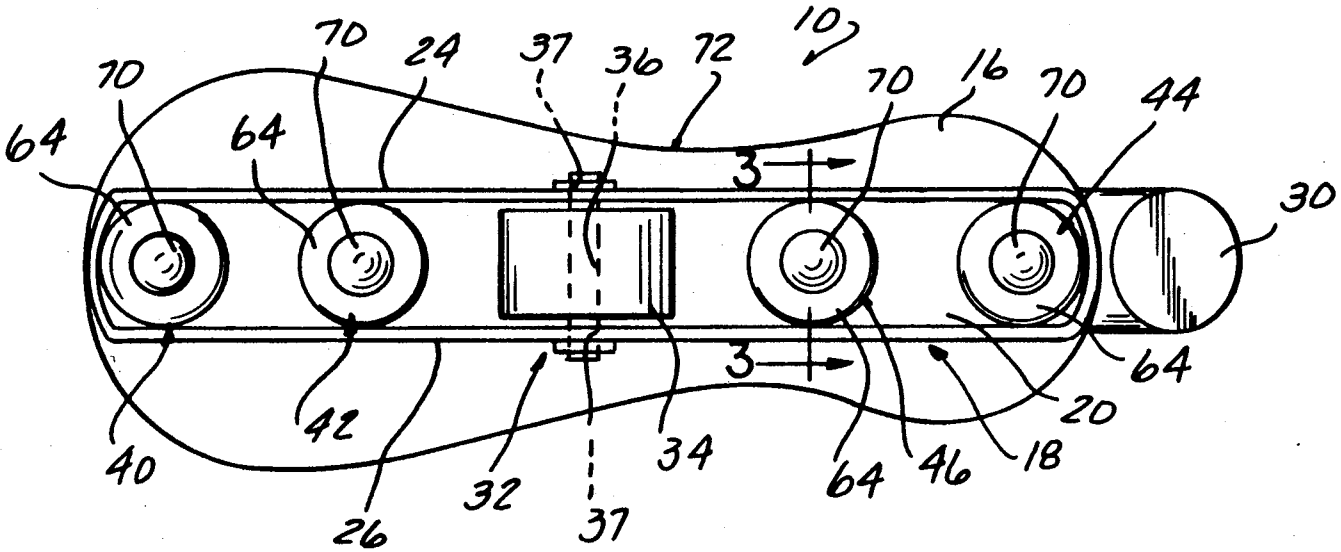
FIG. 2 is a bottom plan view of the in-line roller skate shown in FIG. 1.
Figure 3:
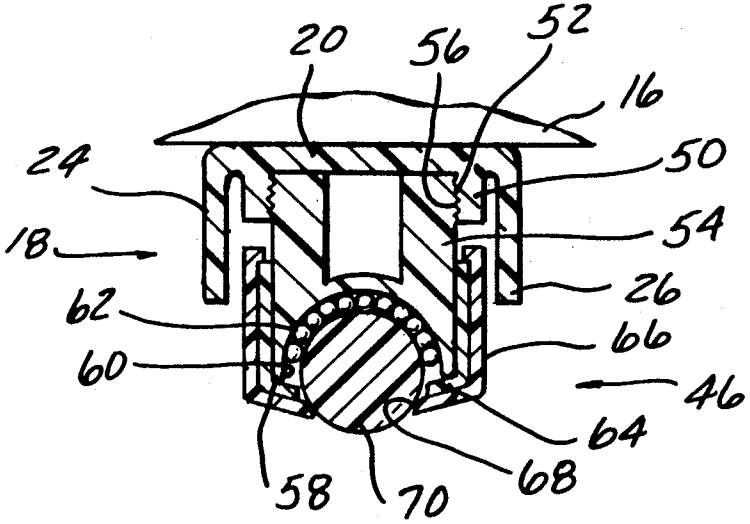
FIG. 3 is a cross sectional view generally taken along line 3—3 in FIG. 2.

A frame 18 is attached to the sole 16 of the boot in the first embodiment of the present invention. As shown in FIGS. 1, 2 and 3, the frame 18 includes a top 20, an open bottom denoted by reference number 22, and first and second spaced side rails 24 and 26, respectively The top 20 and the first and second side rails 22 and 24 are preferably integrally formed as a single, unitary structure from a suitable material, such as a moldable plastic. The opposed ends of the first and second side rails 24 and 26 are disposed adjacent the front and rear ends of the frame 18 and may be closed in a unitary manner as shown in FIG. 2.

The frame 18 is attached to the sole 16 of the boot 12 by any suitable means. Fasteners or rivets may be used to connect the sole 16 to the top portion 20 of the frame 18. Alternately, the top 20 of the frame 18 may be integrally molded with the sole 16 of the boot 12. A separate clip-on, removable frame mounting means is described hereafter and shown in FIG. 5

A resilient bumper 30 is optionally mounted on a rear portion of the frame 18. The bumper 30 is formed of any suitable resilient material, such as rubber, synthetic plastic, etc., and is useful in stopping, starting and/or turn maneuvers during use of the roller skate 10. An optional front mounted bumper, not shown, may be provided at the forward end of the frame 18.

A wheel denoted in general by reference number 32 is mounted to the frame 18 between the front and rear ends of the frame 18. The wheel 32 may be mounted anywhere along the length of the frame 18. Preferably, however, the wheel 32 is positioned between the center and the rear end 26 of the axial extent of the frame 18 so as to be located below the center of weight of the user of the roller skate 10. By way of example only, the wheel 32 is depicted in FIGS. 1 and 2 as being located substantially centrally between the front and rear ends 24 and 26 of the frame 18.

The wheel 32 includes a cylindrical wheel or roller 34 which is mounted about an axle 36. The axle 36, which may be disposed concentrically within a bushing, not shown, has outwardly extending ends which extend through aligned apertures 37 in the side rails 24 and 26 of the frame 18. Suitable fasteners may be employed to secure the ends of the axle 36 in place on the frame 18. Other axle configurations may also be provided to mount the wheel 34 to the frame 18. The axle 36 may be integrally formed with the cylindrical wheel 34 and have outwardly extending, cylindrical end portions which are rotatably mounted in the apertures 37 in the side rails 24 and 26. Further, bushings may be mounted in the apertures 37 in the side rails 24 and 26 such that the integral axle 36 and wheel 34 may rotate therein. As shown in FIGS. 1 and 2, the axle 36 is disposed substantially perpendicular to the longitudinal extent of the side rails 24 and 26 and is located substantially centrally between the ends of the side rails 24 and 26.

A plurality of ball rollers are provided on the frame 18. At least one ball roller, such as ball roller 40, is disposed forward of the wheel 32 in the frame 18. At least one rear ball roller 44 is mounted rearward of the wheel 32 in the frame 18 in the embodiment shown in FIGS. 1 and 2. Preferably, at least two forward mounted ball rollers 40 and 42, respectively, are mounted in the frame 18 between the front end of the frame 18 and the wheel 32. Similarly, two rear ball rollers 44 and 46 are mounted in the frame 18 rearward of the wheel 32. The ball rollers, 40, 42, 44 and 46 are co-axially arranged, in-line along the longitudinal extent of the frame 18. The numbers of front and rear ball rollers will, of course, vary depending on the position of the wheel 32 in the frame 18. If the wheel 32 is positioned immediately adjacent the rear end 26 of the frame 18, there will only be one or more front ball rollers and no rear ball rollers.

Various means may be employed to mount each of the ball rollers 40, 42, 44 and 46 to the frame 18. Such ball mounting means may include integral molding with the frame 18, threaded engagement, sonic welds, snap-on bosses, as well as fasteners which extend through the top 20 of the frame 18 into engagement with each ball roller. One example of a ball mounting means is described hereafter and shown in detail in FIGS. 3 and 4.

In this embodiment, the ball mounting means includes a cylindrical sleeve 50 which is joined to or integrally formed with the frame 18 and depends downward from the top 20 of the frame 18. The sleeve 50 has a hollow interior in which a plurality of threads 52 are formed.

A base 54 having a generally cylindrical shape is provided with a plurality of external threads 56 at an outer end. The threads 56 threadingly engage the threads 52 in the sleeve 50 to securely mount the base 54 to the frame 18. It will be understood that a reverse male/female threaded engagement may be provided in which the sleeve 50 is formed of a reduced diameter and provided with external threads which engage internal threads formed in a bore in the base 54.

As shown in FIG. 3, the side walls of the base 54 extend downward from an outer end to a lowermost, annular edge 58. An inverted, concave bed 60 is formed in the base 54 and extends concavely inward from the annular edge 58 toward the top portion 20 of the frame 18. A plurality of bearings, such as ball bearings 62, are rotatably disposed in the bed 60. A bearing retainer 64 is mounted about the side walls of the base 54 to retain the bearings 62 in the bed 60.

A cap 66 is removably mountable to the base 54, such as, for example, by spring contact. The end cap 66 has an aperture 68 formed centrally in a lower end wall. A ball roller 70 is rotatably disposed in contact with the bearings 62. A lower portion of the ball roller 70 extends outward through the aperture 68 in the cap 66 and is engageable with the surface on which the roller skate 10 is used.

Figure 4:
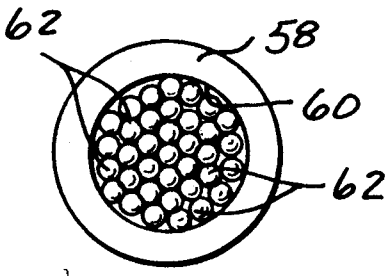
FIG. 4 is a bottom plan view of the ball bearings and bed employed in the ball roller mounting means of the present invention.

The bearings 62, as shown in FIG. 4 are provided in a sufficient quantity to substantially cover the entire surface of the bed 60. This provides a maximum amount of contact surface for the ball roller 70 so as to reduce friction and provide a maximum amount of support for the ball roller 70. This enables the ball roller 70 to rotate freely in any direction since the bearings 62 cover a major portion of the surface of the ball roller 70.

The ball roller 70 is preferably formed of a suitable, high-strength material, such as a hard rubber, a synthetic plastic, such as a urethane, etc. This enables the roller skate 10 to be employed on any surface, such as hard concrete, asphalt, as well as on wood floors.

According to the preferred embodiment, the wheel 32, each of the ball rollers 40, 42, 44 and 46, and the ball mounting means employed to mount each ball roller to the frame 18 are preferably formed of lightweight, high strength plastic material. This affords easy manufacture of the roller skate 10 of the present invention at a low manufacturing cost. Of course, for high strength applications, certain of the components of the ball mounting means may be formed of higher strength materials, such as various metals.

In using the roller skate 10 of the present invention, the wheel 32 provides directional control since it is movable only in a forward and rearward direction. This is important during starting and stopping maneuvers as well as in controlling turns. However, the universally rotatable ball rollers mounted forward and rearward of the wheel 32 enable the user to perform various maneuvers, such as spins, turns, etc., which have been heretofore difficult with conventional in-line roller skates having a plurality of rollers mounted about fixed axles.

Another embodiment of the roller skate of the present invention is shown in FIG. 5. In this embodiment, the roller skate 70 is configured for removable attachment to a user's foot or shoe. The roller skate 70 is provided with a generally shoe-shaped sole member 72. The sole member 72 may have a generally planar configuration or may be provided with a raised heel portion as desired. The frame 18 including a plurality of ball rollers 40, 42, 44 and 46 and a fixed wheel 32, as described above, is attached to the sole 72 by suitable means, such as fasteners, welding, heat staking, etc.

Strap means are provided for releasably mounting the roller skate 70 about the foot or shoe of a user. The strap means comprises at least two pairs of straps, such as strap pairs 74 and 76, respectively located adjacent the front and rear portions of the sole 72. Each strap pair, such as strap pair 74, includes first and second straps 78 and 80 which are each permanently attached at a first end 82 to the sole 72 or to the frame 18. Such attachment may be by means of integral molding, adhesive, sonic or heat welding, etc. The straps 78 and 80 are formed of a flexible material, such as a fabric, plastic, etc.

The free ends 84 and 86 of each of the straps 78 and 80, respectively, are provided with engageable closure means denoted in general by reference number 88. The closure means 88 may comprise any conventional buckle, clasp or the use of a releasably Velcro-type hook and pile members. The closure means 88 enable the free ends 84 and 86 of the straps 78 and 80 of each strap pair 74 and 76 to be wrapped in tight engagement about a portion of the user's foot or shoe to securely attach the roller skate 70 to the user's foot or shoe.

In yet another embodiment similar to that shown in FIGS. 1 and 2, the roller skate 10 is provided with only a plurality of ball rollers and lacks a fixed wheel 32. This arrangement provides greater freedom of maneuverability; but with a slight decrease in control.

In summary, there has been disclosed a unique in-line roller skate which affords greater maneuverability than previously devised in-line skates. The in-line roller skate of the present invention includes, in one embodiment, a plurality of universally rotatable balls mounted on opposite sides of a wheel rotatably mounted on an axle attached to the skate frame. This combination of a fixed wheel and a plurality rotatable ball rollers affords greater maneuverability; while, at the same time, a requisite amount of directional control of the roller skate. The roller skate of the present invention is simply constructed of low cost, moldable materials. Further, the ball rollers are seated in a base which contains bearings covering substantially all of the surface of a bed in the base. The bearings provide greater ease of rotation and additional support for the ball rollers since a large portion of each ball roller engages the bearings.

What is claimed is:

1. An in -line roller skate comprising:

a frame having a top, an open bottom and a pair of parallel, spaced side rails extending forward and rearwardly between opposed front and rear ends;

means for attaching the frame to a boot;

an axle mounted in and extending between the side rails and between the opposed front and rear ends of the side rails;

a wheel rotatably mounted to the axle for rotation about the axis of the axle;

a pair of longitudinally spaced front mounted ball rollers disposed forwardly of the wheel and mounted in the frame for unidirectional movement;

a pair of longitudinally spaced rear mounted ball rollers disposed rearwardly of the wheel and mounted in the frame for unidirectional movement;

the pair of front mounted ball rollers, the pair of rear mounted ball rollers, and the wheel being mounted in the frame such that a surface contacting portion of each is co-planarly arranged along the frame; and ball mounting means for rotatably mounting each ball roller of the pairs of front and rear mounted ball rollers to the frame, the ball mounting means including:

a base attached to the frame and having a concave bed formed therein;

a plurality of bearings rotatably disposed on the bed and covering substantially the entire surface of the bed; and a cap removably mountable over the base, the cap having an aperture formed in an end wall;

each ball roller of the pairs of front and rear mounted ball rollers rotatably engaging the bearings in the bed and having a portion thereof extending outward through the aperture in the cap.

2. The in-line roller skate of claim 1 further comprising:

a plurality of front mounted ball rollers axially disposed in line with the wheel in the frame.

3. The in-line roller skate of claim 1 wherein:

the axle and wheel are disposed substantially centrally between the front and rear ends of the frame.

4. The in-line roller skate of claim 3 further including:

a plurality of rear mounted ball rollers axially disposed in line in the frame rearward of the wheel.

5. The in-line roller skate of claim 1 wherein:

the frame, the pairs of front and rear mounted ball rollers, the wheel and the ball mounting means are formed of plastic.

6. The in-line roller skate of claim 1 further comprising:

a bearing retainer mounted between the base and the cap for retaining the bearings in the bed when the ball roller of each of the pairs of front and rear mounted ball rollers and the cap are mounted on the base.

7. An in-line roller skate comprising:

a frame having a top, an open bottom and a pair of parallel, spaced side rails extending forward and rearwardly between opposed front and rear ends;

means for attaching the frame to a boot;

an axle mounted in and extending between the side rails and substantially centrally between the opposed front and rear ends of the side rails;

a wheel rotatably mounted on the axle for rotation about the axis of the axle;

a plurality of longitudinally spaced front ball rollers disposed forwardly of the wheel and mounted in the frame for unidirectional movement;

a plurality of longitudinally spaced rear ball rollers disposed rearwardly of the wheel and mounted in the frame for unidirectional movement;

the plurality of front ball rollers, the plurality of rear ball rollers, and the wheel being mounted in the frame such that a surface contacting portion of each is co-planarly arranged along the frame;

ball mounting means, mounted in the frame, for rotatably mounting each ball roller of the plurality of front ball rollers and the plurality of rear ball rollers to the frame, the ball mounting means including:

a base mounted to the frame and having a concave bed formed therein;

a plurality of bearings rotatably disposed on the bed and covering substantially the entire surface of the bed; and a cap removably mountable over the base, the cap having an aperture formed in an end wall;

each of the plurality of front and rear ball rollers rotatably engaging the bearings in the bed and having a portion thereof extending outward through the aperture in the cap;

a bearing retainer mounted between the base and the cap for retaining the bearings in the bed when the ball and cap are mounted on the base; and the frame, the plurality of front and rear ball rollers, the wheel and the ball mounting means being formed of plastic.

8. An in-line roller skate comprising:

an elongated, generally planar sole member;

a frame having a top, an open bottom and a pair of parallel, spaced side rails extending forward and rearwardly between opposed front and rear ends;

means for attaching the frame to the sole member;

an axle mounted in and extending between the side rails and between the opposed front and rear ends of the side rails;

a wheel rotatably mounted to the axle for rotation about the axis of the axle;

a pair of longitudinally spaced front mounted ball rollers disposed forwardly of the wheel and mounted in the frame for unidirectional movement;

a pair of longitudinally spaced rear mounted ball rollers disposed rearwardly of the wheel and mounted in the frame for unidirectional movement;

the pair of front mounted ball rollers, the pair of rear mounted ball rollers, and the wheel being mounted in the front such that a surface contacting portion of each is co-planarly arranged along the frame; and ball mounting means, mounted in the frame, for rotatably mounting each ball roller of the pair of front mounted ball rollers and the pair of rear mounted ball rollers to the frame, the ball mounting means including:

a base attached to the frame and having a concave bed formed therein;

a plurality of bearings rotatably disposed on the bed and covering substantially the entire surface of the bed;

a cap removably mountable over the base, the cap having an aperture formed in an end wall; and each ball roller of the pair of front and rear mounted ball rollers rotatably engaging the bearings in the bed and having a portion thereof extending outward through the aperture in the cap.

9. The in-line roller skate of claim 8 further comprising:

connector means, mounted to the sole member, for releasably attaching the sole member to the foot of a user.

10. The in-line roller skate of claim 9 wherein the connector means comprises:

a plurality of pairs of straps, each strap of each pair of straps having one end attached to the sole member and a second free end; and closure means mounted on the free ends of the straps and releasably engageable with the complimentary closure means on the free end of an associated strap for releasably securing the straps about the foot of a user.

11. The in-line roller skate of claim 9 wherein:

the axle and wheel are disposed substantially centrally between the front and rear ends of the frame.

12. The in-line roller skate of claim 11 further including:

a plurality of rear mounted ball rollers axially disposed in line in the frame rearwardly of the wheel.

13. The in-line roller skate of claim 8 wherein:

the frame, the pairs of front mounted and rear mounted ball rollers, the wheel and the ball mounting means are formed of plastic.

14. The in-line roller skate of claim 8 further comprising:

a bearing retainer mounted between the base and the cap for retaining the bearings in the bed when the ball roller of each of the pairs of front and rear mounted ball rollers and the cap are mounted on the base.

15. The in-line roller skate of claim 8 further comprising:

a plurality of front mounted ball rollers axially disposed in line with the wheel in the frame.

* * * * *